United States Patent [19]

Badaliants et al.

[11] 4,135,917

[45] Jan. 23, 1979

[54] PROCESS FOR RECOVERING GALLIUM FROM ALKALI ALUMINATE SOLUTIONS RESULTING FROM TREATMENT OF ALUMINUM-CONTAINING ORES

[76] Inventors: Khoren A. Badaliants, Sportivnaya ulitsa, 4, kv. 37, Pikalevo Leningradskoi oblasti; Arkady A. Belsky, Komsomolsky prospekt, 48/22, kv. 20, Moscow; Leonid M. Butorin, ulitsa Gavanskaya, 10, kv. 18, Leningrad; Anna E. Danilina, ulitsa Fedora Poletaeva, 8, korpus 5, kv. 63; Alexandr V. Eljutin, 3 Frunzenskaya ulitsa, 7, kv. 176, both of Moscow; Isaak A. Zatulovsky, Sovetskaya ulitsa, 29, kv. 46, Pikalevo Leningradskoi oblasti; Arkady I. Zazubin, ulitsa Vinogradova, 33, kv. 20, Alma-Ata; Raisa V. Ivanova, ulitsa Udaltsova, 14, kv. 181, Moscow; Evgeny A. Isakov, ulitsa Sovetskaya, 28, kv. 16; Ivan M. Kostin, Sportivnaya ulitsa, 4, kv. 16, both of Pikalevo Leningradskoi oblasti; Askar M. Kunaev, ulitsa Vinogradova, 20, kv. 7, Alma-Ata; Teodor G. Milberger, ulitsa Sovetskaya, 27, kv. 40; Petr F. Minin, ulitsa Shkolnaya, 66, kv. 38, both of Pikalevo Leningradskoi oblasti; Nikolai A. Novikov, ulitsa Korolenko, 4/14, kv. 10, Moscow; Tatyana D. Ostapenko, ulitsa Mira, 144, kv. 57, Alma-Ata; Alexandr V. Peredereev, M.Filevskaya ulitsa, 40, kv. 25, Moscow; Garegin A. Peikarov, 6 mikroraion, 34, kv. 82, Pikalevo Leningradskoi oblasti; Gennady A. Romanov, ulitsa Astronomicheskaya, 63, kv. 18, Alma-Ata; Anatolia T. Simanova, ulitsa Sovetskaya, 56, kv. 65, Pikalevo Leningradskoi oblasti; Natalya V. Tishevetskaya, ulitsa Maxima Gorkogo, 60, kv. 4, Alma-Ata; Georgy P. Tkachenko, Slavyansky bulvar, 43, kv. 221, Moscow; Elena L. Shalavina, ulitsa Vinogradova, 33, kv. 20, Alma-Ata; Leonid I. Finkelshtein, ulitsa Chkalova, 45, kv. 2, Achinsk Krasnoyarskogo kraya; Nikolai S. Shmorgunenko, I Linia, 28, kv. 15, Leningrad, all of U.S.S.R.

[21] Appl. No.: 862,201

[22] Filed: Dec. 19, 1977

[30] Foreign Application Priority Data

Dec. 22, 1976 [SU] U.S.S.R. ..... 2428006

[51] Int. Cl.[2] ..... C22B 58/00; C25C 1/24

[52] U.S. Cl. ..... 75/109; 75/121; 204/105 R; 423/129

[58] Field of Search ..... 75/109, 121; 204/105 R; 423/129

[56] References Cited

U.S. PATENT DOCUMENTS

| | | | |
|---|---|---|---|
| 3,094,378 | 6/1963 | Wolf | 75/121 X |
| 3,170,857 | 2/1965 | Dotzer | 204/59 |
| 3,677,918 | 7/1972 | Miyake | 204/105 R |
| 3,890,427 | 6/1975 | Dewey et al. | 204/105 R |
| 3,933,604 | 1/1976 | Honey et al. | 204/123 |
| 3,988,150 | 10/1976 | Shalavina et al. | 75/109 |
| 4,061,551 | 12/1977 | Ivanova et al. | 204/105 R |

*Primary Examiner*—G. Ozaki

*Attorney, Agent, or Firm*—Lackenbach, Lilling & Siegel

[57] ABSTRACT

A process for recovering gallium from alkali aluminate solutions which consists in that the starting alkali aluminate solution is neutralized to a concentration of the caustic alkali of from 0.1 to 10 g/l, whereafter the neutralized liquor is evaporated to a concentration of the caustic alkali therein of from 30 to 150 g/l. Then the evaporated solution is corrected to obtain the ratio between the alkali metal oxide and alumina of above 2.0. The corrected solution is treated with a liquid alloy of gallium containing an element possessing an oxidizing potential exceeding that of gallium to give a concentrate containing more than 90% of gallium by mass, wherafter gallium of a higher purity grade is recovered from the resulting concentrate by the electrochemical method.

The process according to the present invention makes it possible to recover gallium from alkali solutions resulting from the treatment of nephelines with the production of a 90% gallium concentrate, wherefrom gallium of an increased purity is obtained at relatively low cost. Processing of the concentrate with the production of gallium is simple, it is not encountered with any additional expenses and requires no additional equipment.

Another advantage of the process resides in a more comprehensive utilization of low-grade aluminum-containing ores.

5 Claims, No Drawings

PROCESS FOR RECOVERING GALLIUM FROM ALKALI ALUMINATE SOLUTIONS RESULTING FROM TREATMENT OF ALUMINUM-CONTAINING ORES

The present invention relates to hydrometallurgy of rare metals and, more specifically, to a process for recovering gallium from alkali aluminate solutions resulting from the treatment of aluminum-containing ores.

FIELD OF APPLICATION OF THE INVENTION

The present invention is useful in the recovery of gallium from alkali aluminate solutions resulting from comprehensive treatment of aluminum-containing ores such as nephelines.

The process according to the present invention is also useful for recovering gallium from alkali solutions containing aluminates, carbonates, vanadates, chromates, molybdates, phosphates, chlorides, silicates, ferrates, zincates of alkali metals. Liquors of the above-mentioned composition containing gallium in various amounts result from the treatment of nephelines.

Gallium is currently employed as a component for semi-conductive compounds of the type $A^{III}B^{V}$, alloys for tooth fillings, liquid current-collectors in electric machines, working medium in radiation circuits as well as in high-temperature thermometers.

Production of metallic gallium from said solutions is effected in two stages, namely: concentration of gallium and processing of the resulting concentrate.

Despite the fact that the content of gallium in nephelines is about 2 times as less as in bauxites — principal raw materials for the production of gallium — gallium can be concentrated in liquors and economically efficiently recovered therefrom in the treatment of nephelines.

BACKGROUND OF THE INVENTION

Gallium is now produced mainly from the solutions resulting from the treatment of bauxites following the Bayer method; in doing so, thickening of gallium solutions is performed by various methods.

Known in the art is a process for producing gallium from alkali aluminate solutions resulting from the Bayer process, wherein the concentration is effected by precipitation of aluminum in the form of tricalcium aluminate by means of lime in autoclaves, followed by carbonization of these solutions to convert all the caustic alkali to bicarbonates and to give a concentrate containing 0.3 to 1% by mass of gallium.

This process involves the steps which are not characteristic of the Bayer process; it is accompanied by losses of aluminum and high production costs of the final gallium product.

In another prior art process an alkali aluminate solution resulting from the treatment of bauxites is reacted with carbonic acid to recover about 90% of aluminum in the form of hydroxide thereof; then the solution is stirred and subjected to a repeated carbonization to convert all the caustic alkali to the bicarbonate form thereof. The thus-produced concentrate contains, percent by mass: 0.45 of gallium oxide, 23.6 of carbon dioxide, 47.4 of aluminum oxide, 18.4 of sodium oxide, 9.5 of water. From the resulting concentrate gallium is passed into an alkaline solution, wherefrom gallium is recovered by means of electrolysis. The process does not ensure a required thickening of gallium even from alkali aluminate solutions resulting from the treatment of bauxites containing gallium in greater amounts than alkali aluminate solutions resulting from the treatment of nephelines.

Since the content of gallium in alkali aluminate solutions resulting from the production of alumina from nephelines is by 10 to 20 times as less as in the liquors resulting from the treatment of bauxites by the Bayer process, said methods of concentration and recovery of gallium cannot be successfully applied for the recovery of this metal from intermediate products of the treatment of nephelines.

Known in the art is a process for producing gallium from the solutions resulting from the treatment of aluminum-containing ores which involves stages of concentration and recovery of metallic gallium, wherein concentration of gallium is effected by treatment of a gallium-containing solution with an alloy of mercury with sodium (sodium amalgam) to give a sodium concentrate in mercury containing 0.3 to 3% by mass of gallium, wherefrom gallium is recovered by converting it into an alkaline solution, followed by an electrochemical reduction of gallium, for example on a solid cathode.

Toxic nature of mercury, low solubility of gallium therein, as well as considerable losses of mercury with the liquors being treated — all this substantially restricts the possibilities of a commercial application of this prior art process.

A common disadvantage of the above-discussed prior art processes for recovering gallium resides in a low degree of concentration of gallium and, consequently, high costs of production of this metal.

It is an object of the present invention to provide such a process which would make it possible to recover gallium from alkali aluminate solutions resulting from the treatment of low-quality aluminum-containing ores such as nephelines at rather low production costs.

BRIEF SUMMARY OF THE INVENTION

This object is accomplished by that in a process for recovering gallium from alkali aluminate solutions resulting from processing of aluminum-containing ores including steps of concentration of gallium and recovery of gallium from the resulting concentrate by way of an electrochemical reduction in accordance with the present invention said solutions are neutralized to a concentration of a caustic alkali of from 0.1 to 10 g/l, then evaporated to a concentration of the caustic alkali therein of from 30 to 150 g/l, whereafter the solutions are corrected to obtain the ratio between oxide of the alkali metal to alumina of above 2.0; then the corrected solutions are treated with a liquid gallium alloy containing an element with an oxidizing potential exceeding that of gallium to give a concentrate containing more than 90% by mass of gallium; and gallium of an increased purity is obtained from the resulting concentrate by the electrochemical method.

The process according to the present invention makes it possible, at relatively low production costs, to recover gallium from alkali aluminate solution resulting from the treatment of nephelines to give a 90% gallium concentrate, wherefrom gallium of a higher purity grade is produced. The treatment of the concentrate with the production of gallium does not entail any additional expenses and requires no additional process equipment. Another advantage of the process according to the present invention resides in a more comprehensive utilization of low-grade aluminum-containing ores.

In the process according to the present invention the solution neutralization should be preferably performed by treating the same with a gas containing carbon dioxide. In doing so, the components which are foreign in the alumina production are not brought into the solution while the neutralization process can be readily controlled and automated.

After neutralization the solution should be evaporated to a concentration of the caustic alkali within the range of from 30 to 150 g/l. This technique will ensure the best conditions for concentration of gallium and enables the production of certain valuable materials such as soda and potash.

After separation of the alkali metal salts, the solution should be corrected with respect to the content of the alkali metal oxide and alumina; the ratio between said components in the solution should be preferably maintained above 2.0.

This correction should be preferably effected by treating the solution with the products containing an oxide and/or hydroxide of the alkali metals and calcium. These compounds are characteristic of the intermediate and auxiliary products in the alumina production; they are interchangeable and in certain cases can mutually complement each other. Depending on the presence of one of these products in the production process, these should be used for the solution correction.

The solution corrected with respect to the content of the principal components and gallium, should preferably be treated with a liquid alloy of gallium containing aluminium in an amount of from 0.05 to 2% by mass. This makes it possible to produce a concentrate containing more than 90% by mass of gallium.

The resulting concentrate should be treated electrochemically which is the most preferred method in this case. To this end, a concentrate containing more than 90% by mass of gallium should be dissolved in an alkali solution wherefrom gallium of an increased purity can be recovered by cementation or electrolysis. This enables the production of metallic gallium of a higher purity grade with the content of such impurities as copper, iron, silicon, zinc, cadmium, aluminium, and lead of the order of from $n \cdot 10^{-3}$ to $n \cdot 10^{-5}$% by mass.

Other objects and advantages of the process according to the present invention will now be more fully apparent from the following detailed description of the recovery of gallium from alkali solution resulting from the treatment of aluminium-containing ores and examples illustrating its embodiments.

DETAILED DESCRIPTION OF THE INVENTION

The alkali aluminate solutions resulting in the treatment of nepheline contain, on the average, g/l: 90 to 120 of sodium oxide, 50 to 100 of alumina, 0.1 to 0.05 of silica, 0.01 to 0.1 of iron, and 0.2 to 1 of organic compounds. The content of gallium in these solutions ranges from 0.01 to 0.02 g/l.

Despite such a low content of gallium as compared to that in the solutions resulting from the treatment of bauxites the process according to the present invention ensures an effective concentration of gallium and a subsequent production of a metal possessing substantially increased purity.

In accordance with the present invention, the first step of concentration of gallium resides in lowering the content of the caustic alkali in the starting alkali aluminate solution down to 0.1–10 g/l. This is effected by neutralization of the solution by a reagent binding hydroxyl ions. To this end, mineral acids can be used, such as hydrochloric acid, sulphuric acid or nitric acid. The use of said acids for neutralization is accompanied by the introduction, into the alkali aluminate liquor, of chlorine and sulphate sulphur which, in the subsequent treatment of said solutions and recovery of the desired products therefrom such as aluminum hydroxide, soda and potash, contaminate these products and impair their quality.

It has been found that the best results in the solution neutralization are obtained when the solution is treated with carbon dioxide. In this case use is made either of an aqueous solution of carbon dioxide, pure carbon dioxide or gases containing carbon dioxide.

In the process according to the present invention, the solution is heated to a temperature within the range of from 50 to 120° C. and then treated with any of the foregoing products containing carbon dioxide.

During the treatment of the alkali aluminate solution, caustic alkali is converted into its carbonate form, thus providing favourable conditions for hydrolysis of sodium aluminate present in the solution, as well as for the formation of a precipitate of aluminium hydroxide and recovery of the latter from the solution.

The final conditions of neutralization, i.e. concentration of the caustic alkali of from 0.1 to 10 g/l are selected with the view to maximal removal of aluminum from the alkali aluminate solution and retaining gallium in the liquor. At a deeper neutralization gallium is co-precipitated with aluminum and irrevocably lost.

After separation of aluminum from the solution, e.g. by filtration or sedimentation, the solution is evaporated to a concentration of the caustic alkali of from 30 to 150 g/l.

It has been found that the best conditions ensuring an efficient concentration of gallium are obtained upon increasing concentration of the caustic alkali in the alkali aluminate solution up to 30–150 g/l by way of heating the liquor to a temperature within the range of from 40 to 200° C. and maintaining said solution at this temperature for a certain period ensuring liberation of salts of alkali metals such as potassium and sodium. This technique is effected with the use of conventional equipment widely used in the chemical industry, e.g. evaporation apparatus.

The solution resulting from evaporation contains mainly, g/l: 300 to 600 of total alkali (calculated for sodium oxide), 30 to 80 of alumina, 0.3–1.5 of silica, and 0.3–1.5 of gallium.

In accordance with the present invention, this solution can be also subjected to neutralization and evaporation as it has been mentioned hereinabove, so as to recover additional amounts of the alkali metal salts and to ever more increase the content of gallium in the solution.

After separation of compounds of alkali metals, the solution is subjected to correction to obtain the ratio between the alkali metal oxide and alumina of more than 2. Thereafter, the solution acquires an increased stability and is not decomposed.

To achieve said ratio, the solution is treated, for example, with an oxide of alkali metals or calcium at a temperature within the range of from 50 to 100° C. In doing so, a portion of the carbonate alkali is converted to the caustic alkali, whereas a certain amount of aluminum, at most 5–10% by mass, is precipitated in the form of tricalcium hydroaluminate which is accompanied by variation of the ratio between the alkali metal oxide and alumina until a required value of the ratio is reached.

Other ways of correction of solutions to achieve the above-mentioned ratio between the alkali metal oxide and alumina reside in the treatment of the solutions by means of hydroxides of alkali metals or calcium or products based thereon. The use of this or that reagent in each particular case depends on the quality of the raw materials being treated, the presence of impurities, and availability of any of the products suitable to make the required correction.

The present invention provides for an opportunity of correction of alkali aluminate solutions by means of products containing oxide and hydroxide of alkali metals and calcium.

After the correction, the solution contains mainly, g/l: 200 to 300 of the alkali metal oxide, 30 to 40 of alumina, 0.5 to 0.1 of silica, and 0.3 to 3.0 of gallium.

To recover gallium as a concentrate from the corrected solutions use can be made of different methods for precipitation thereof, including cupferron method, ferrocyanide method, cryolite method, acetic-acid method, and the hydroxyquinoline method. However, these methods have an essential disadvantage residing in that the alkali solutions containing aluminum are broken after such a treatment and cannot be further used for the production of aluminum and should be discarded as waste products.

It has been found that the most efficient method of precipitation of gallium from solutions to ensure the formation of a concentrate containing gallium in an amount of above 90% by mass comprises the treatment of the solutions by means of an alloy of gallium containing an element with an oxidizing potential exceeding that of gallium, i.e. sodium, potassium or aluminum. The resulting solution is heated to a temperature within the range of from 40 to 90° C. and treated, e.g. with an alloy of gallium containing 0.05 to 2.0% by mass of aluminum. In doing so, the reaction of mutual displacement of the metals occurs, which results in dissolution of the aluminum of the alloy in the solution, while gallium is recovered from the solution as a concentrate containing more than 90% by mass of gallium. To produce one kg of the concentrate of gallium, there are consumed 10–20 kg of aluminum. The resulting concentrate is separated from the solution and from the gallium-aluminum alloy, dissolved in a solution containing a caustic alkali. From the resulting alkali solution of the gallium concentrate gallium is recovered by the electrochemical method. Thus, such recovery is effected by means of cementation or electrolysis. In both cases the resulting gallium has an improved purity grade.

The process according to the present invention makes it possible to obtain gallium with the following content of impurities, percent by mass: $1 \cdot 10^4$ nickel, $1.4 \times 10^{-4}$ of zinc, $1 \cdot 10^{-3}$ of copper, $1 \cdot 10^{-4}$ of aluminium, $5 \cdot 10^{-4}$ of lead, $1 \cdot 10^{-4}$ of magnesium, $1 \cdot 10^{-4}$ of iron, $3 \cdot 10^{-4}$ of silicon, and $1 \cdot 10^{-4}$ of tin.

Technical economic efficiency of the process according to the present invention is proven by a high degree of concentration and recovery of gallium, simple technology of the production process, the use of intermediate products from alumina and soda production as auxiliary reagents, as well as by much better quality of the final products of alumina and soda production such as alumina, soda, potash due to a reduced content of impurities and gallium therein. The process according to the present invention is rather simple and can be easily implemented at any plant processing nepheline raw materials by the sintering method. Return-on-investement period for a plant with an annual capacity of 5–10 tons of gallium is about 1–1.5 years.

For a better understanding of the present invention, some specific examples illustrating the process for recovering gallium are given hereinbelow.

EXAMPLE 1

200 $m^3$ of the starting alkali solution resulting from the treatment of nepheline containing substantially, g/l: 88.7 of total alkali containing 81.5 of caustic alkali; 71.9 of alumina, 0.02 of gallium, 0.034 of silica, 0.277 of chlorine, 3.12 of sulphate sulphur, and 0.1 of organic compounds are treated at the temperature of 70° C. with a gas containing 14% of carbon dioxide to obtain the concentration of the caustic alkali in the solution of 1.5 g/l. After the treatment the liquor contains, g/l: 0.9 of alumina, 0.016 of gallium, and 89.5 of total alkali. The resulting aluminum hydroxide is separated by filtration. The remaining solution is evaporated by passing through a series of evaporation apparatus. Therewith, the solution is heated to the temperature of 130° C. Salts of potassium and sodium are recovered from the solution, whereafter the solution has the following composition, g/l: 350 of total alkali containing 81 of caustic alkali, 10 of alumina, 1.2 of gallium, and 0.7 of silica.

This solution is treated with calcium oxide at the temperature of 90° C. for 2 hours. After separation of the calcium precipitate the solution contains substantially, g/l: 370 of total alkali containing 113 of caustic alkali, 62 of alumina, 1.2 of gallium, and 0.01 of silica. The resulting solution is passed through an apparatus, wherein it is treated, at the temperature of 63° C., with a liquid gallium alloy containing 1.0% by mass of aluminum. The process duration is 2 hours. The residual content of gallium in the liquor is 0.2 g/l at the consumption rate of aluminum of 12 parts by weight per 1 part by weight of the reduced gallium.

Gallium is recovered in the form of a concentrate with the content of gallium of 91% by mass.

The concentrate is dissolved in an alkaline solution containing 120 g/l of caustic alkali. In doing so, a solution is obtained containing 100 g/l of gallium. From this solution gallium is recovered by cementation on an alloy of gallium with aluminum containing aluminum in the amount of 6% by mass. The process is conducted at the temperature of 60° C. for 10 hours. The thus-produced metal contains gallium in the amount of 99.9% by mass.

EXAMPLE 2

The starting alkaline solution resulting from the treatment of nepheline (its composition is similar to that described in Example 1 hereinbefore) in the amount of 200 $m^3$ is heated to the temperature of 90° C. and treated with a gas containing 16 vol. % of carbon dioxide to achieve the content of the caustic alkali in the solution of 10 g/l. After the treatment the solution contains, g/l: 7 of alumina, 0.02 of gallium, and 90 of total alkali. The solution is evaporated following the procedure described in the foregoing Example 1.

After evaporation, the solution has the following composition, g/l: 360 of total alkali containing 30 of caustic alkali, 42.7 of alumina, 0.3 of silica, and 0.10 of gallium.

This liquor is again subjected to the treatment with a gas containing 16% of carbon dioxide till the residual content of the caustic alkali becomes 10 g/l, and then it is again evaporated. The content of gallium in the solution is thus increased to 0.9 g/l.

The resulting solution is treated with an aqueous suspension of calcium oxide at the temperature of 90° C. for 2 hours. After separation of the calcium precipitate the solution has the following composition, g/l: 290 of total alkali containing 87.8 of caustic alkali, 36 of alumina, 0.87 of gallium, and 0.012 of silica.

The resulting solution is passed through an apparatus, wherein this solution is treated at the temperature of 60° C. with a liquid gallium alloy containing aluminum in the amount of 0.05% by mass.

The process is conducted for 1 hour 50 minutes. The residual content of gallium in the solution is 0.16 g/l. The consumption rate of aluminum is 13 g per 1 g of the reduced gallium.

Gallium is recovered in the form of a concentrate with the content of gallium of 93% by mass. The concentrate is dissolved in an alkaline solution to give a solution containing 90 g/l of gallium. From this solution gallium is recovered by cementation on an alloy of gallium with aluminum containing 13% by mass of aluminum. The thus-produced metal contains 99.9% by mass of gallium.

EXAMPLE 3

The starting alkali solution (with the composition similar to that described in the foregoing Example 1) in the amount of 200 $m^3$ is heated to 85° C. and treated with carbon dioxide to reduce the content of the caustic alkali down to 0.1 g/l. After the treatment the solution contains, g/l: 0.05 of alumina, 0.005 of gallium and 92 of total alkali.

The resulting solution is evaporated by passing through a series of evaporation apparatus. After the evaporation the solution has the following composition, g/l: 390 of total alkali containing 150 of caustic alkali, 120 of alumina, 0.8 of silica, and 3.0 of gallium. Into the evaporated solution sodium alkali is added to obtain a solution, wherein the ratio between sodium oxide and alumina is 3 to 1. This liquor is passed through an apparatus, wherein it is treated, at the temperature of 60° C., with a liquid gallium containing aluminum in the amount of 0.5% by mass.

The process is conducted for 1 hour 35 minutes. The residual content of gallium in the solution is 0.25 g/l. The consumption rate of aluminum is 8 g per g of reduced gallium. Gallium is recovered in the form of a concentrate with the content of gallium of 90.5%. The concentrate is dissolved in an alkaline solution to give a solution containing 100 g/l of gallium. Gallium is recovered from this solution by way of cementation on an alloy of gallium containing 20% by mass of alumnium. The final metal contains 99.95% by mass of gallium.

EXAMPLE 4

The starting alkali solution resulting from the treatment of nepheline (with the composition similar to that described in Example 1 hereinbefore) in the amount of 200 $m^3$ is heated to the temperature of 90° C. and treated with a gas containing 14% by volume of carbon dioxide till the content of the caustic alkali is equal to 1.5 g/l. After the treatment the solution contains, g/l: 0.9 of alumina, 0.015 of gallium, and 89.5 of total alkali. The resulting solution is evaporated to isolate carbonates of sodium and potassium. After the evaporation the solution has the following composition, g/l: 350 of total alkali containing 30.9 of caustic alkali, 23.9 of alumina, 0.4 of gallium, and 0.3 of silica.

The thus-prepared solution is treated with calcium oxide at the temperature of 95° C. for 2 hours. After separation of the calcium precipitate the solution has the following composition, g/l: 370 of total alkali containing 38.4 of caustic alkali, 21 of alumina, 0.4 of gallium, and 0.01 of silica. This solution is passed through an apparatus, wherein it is treated at the temperature of 60° C. with a liquid gallium containing aluminum in the amount of 0.6% by mass. The process is conducted for 3.5 hours. The residual content of gallium in the solution is 0.08 g/l, consumption rate of aluminum is 17 g per 1 g of reduced gallium. Gallium is recovered in the form of a concentrate with the content of gallium of 91% by mass.

The concentrate is dissolved in an alkaline solution to give a solution containing gallium in the amount of 100 g/l. From this solution 0.76 kg of gallium is recovered by means of cementation performed on an alloy of gallium with aluminum containing 3% of aluminum by mass. The process is conducted at the temperature of 67° C. The final metal contains 99.9% by mass of gallium.

EXAMPLE 5

The starting alkali solution resulting from the treatment of nepheline (with the composition similar to that described in Example 1 hereinbefore) in the amount of 150 $m^3$ with the temperature of 60° C. is neutralized by hydrochloric acid to the content of the caustic alkali of 5 g/l. The precipitate of aluminum hydroxide is separated by sedimentation. The solution resulting from this neutralization contains, g/l: 76 of total alkali, 3.1 of alumina and 0.018 of gallium.

This solution is evaporated with liberation of chlorides of alkali metals to increase the content of caustic alkali to 150 g/l. Concentration of gallium is increased thereby up to 0.55 g/l. The solution is corrected by treating thereof with solid calcium oxide at the temperature of 95° C. After correction the solution has the following composition, g/l: 198 of total alkali containing 156 of caustic alkali, 53 of alumina, 30.6 of chlorine, and 0.61 of gallium. This solution is treated with a gallium alloy containing sodium in the amount of 0.1% by mass to obtain a concentrate containing 97% by mass of gallium.

This concentrate is dissolved in a caustic solution containing 110 g/l of potassium oxide to obtain the content of gallium in the solution of 66 g/l. Metallic gallium with the content of 99.9% by mass of the principal product is produced by electrolysis on a liquid gallium cathode at the temperature of 40° C. and cathodic current density of 500 $A/m^2$.

EXAMPLE 6

The starting alkali solution resulting from the treatment of nepheline (and having the composition described in the foregoing Example 1) in the amount of 150 $m^3$ at the temperature of 60° C. is neutralized with sulphuric acid to the content of caustic alkali of 5 g/l. The precipitate of aluminum hydroxide formed in the neutralization is separated by sedimentation. The clarified solution contains substantially, g/l: 78 of total alkali, 3.4 of alumina, 0.017 of gallium, and 60 of sulphate sulphur. The solution is heated to a temperature within the range of from 110 to 130° C. under a subatmospheric pressure and salts of alkali metals are separated therefrom. After heating and separation of the salts, the solution contains substantially, g/l: 350 of total alkali containing 125 of caustic alkali, 15 of sodium and potassium sulphates, 0.5 of gallium, and 81 of alumina. The solution is corrected by the addition thereinto of potassium hydroxide to achieve the ratio between oxides of the alkali metals and alumina of 4 to 1 and then gallium concentrate is recovered by treating the solution with an alloy of gallium containing 2% by mass of aluminum. The concentrate recovered from the solution contains gallium in the amount of 90.4% by mass. The concentrate is dissolved in a solution containing 190 g/l of potassium oxide to the content of gallium in the solution of 54 g/l. From this solution metallic gallium is obtained by way of an electrochemical reduction on a liquid gallium cathode at the temperature of 65° C. and cathodic current density of 1,000 $A/m^2$. Electrolysis is conducted to the residual concentration of gallium of at most 0.1 g/l. The thus-produced gallium contains 99.95% by mass of the principal product.

EXAMPLE 7

The starting alkali solution resulting from the treatment of nepheline (and have the composition similar to that described in Example 1 hereinbefore) is neutralized by the addition of a solution of carbon dioxide to reduce the caustic alkali concentration down to 2 g/l. The precipitate of aluminum hydroxide formed during neutralization is separated by filtration of a pre-thickened pulp. The clarified solution of the composition, g/l: 86 of total alkali, 1 of alumina and 0.012 of gallium is evaporated in vacuum heating apparatus to the concentration of the caustic alkali of 140 g/l. Separation of salts of the alkali metals performed simultaneously with the evaporation makes it possible to increase concentration of gallium in the solution up to 0.8 g/l.

The solution is subjected to correction by treating the same with an aqueous suspension of calcium oxide to increase the ratio between alkali metal oxides and alumina up to 3.7.

After correction, the solution contains substantially, g/l: 210 of total alkali containing 120 of caustic alkali, 33 of alumina and 0.55 of gallium. From the thus-corrected solution gallium is precipitated in the form of a 96% concentrate by treating the solution with an alloy of gallium containing aluminum in the amount of 0.7% by mass.

With the consumption rate of aluminium of 15 kg per kg of the recovered gallium, the residual concentration of gallium in the solution is 0.05 g/l.

The thus-prepared concentrate is dissolved in a caustic solution containing 130 g of sodium oxide to produce the concentration of gallium in the solution equal to 72 g/l. From this solution gallium is recovered by way of an electrochemical reduction on a gallium alloy containing 1% by mass of aluminum. The resulting metal contains 99.91% by mass of gallium.

What is claimed is:

1. A process for recovering gallium from alkali aluminate solutions resulting from the treatment of aluminium-containing ores comprising neutralization of said solutions to a concentration of a caustic alkali of from 0.1 to 10 g/l, evaporation of the neutralized solutions to a concentration of the caustic alkali therein of from 30 to 150 g/l, correction of the evaporated solutions to achieve the ratio of the alkali metal oxide to alumina of above 2, treatment of the corrected solutions with a liquid gallium alloy containing an element with an oxidizing potential exceeding that of gallium to obtain a concentrate containing more than 90% of gallium by mass, followed by recovering gallium of a higher purity grade from the concentrate by the electrochemical method of cementation or electrolysis method.

2. A process as claimed in claim 1, wherein said neutralization of the solutions is effected by treating the same with a gas containing carbon dioxide.

3. A process as claimed in claim 1, wherein said correction of the solutions is effected by means of products containing compounds selected from the group consisting of oxide or hydroxide of an alkali metal and calcium or a mixture thereof.

4. A process as claimed in claim 1, wherein the corrected solutions are treated with a gallium alloy containing aluminum in an amount of from 0.05 to 2.0% by mass to give a concentrate containing gallium in an amount of more than 90% by mass.

5. A process as claimed in claim 1, wherein gallium of a higher purity grade is obtained by transferring gallium from the resulting concentrate into an alkali solution, followed by recovering gallium from said alkali solution by means of electrolysis or cementation.

* * * * *